US010486890B2

(12) United States Patent
Trinko et al.

(10) Patent No.: US 10,486,890 B2
(45) Date of Patent: Nov. 26, 2019

(54) LOW BULK, CENTER-PULL BAG DISPENSER WITH END-FORMS

(71) Applicant: The Trinko Group, LLC., Menasha, WI (US)

(72) Inventors: Thomas Trinko, Menasha, WI (US); Dominic Trinko, LaCrosse, WI (US)

(73) Assignee: The Trinko Group, LLC, Menasha, WI (US)

( * ) Notice: Subject to any disclaimer, the term of this patent is extended or adjusted under 35 U.S.C. 154(b) by 0 days.

(21) Appl. No.: 14/789,257

(22) Filed: Jul. 1, 2015

(65) Prior Publication Data

US 2016/0001961 A1 Jan. 7, 2016

Related U.S. Application Data

(60) Provisional application No. 62/021,401, filed on Jul. 7, 2014.

(51) Int. Cl.

| | |
|---|---|
| ***B65D 83/08*** | (2006.01) |
| ***B65B 53/00*** | (2006.01) |
| ***B65D 71/08*** | (2006.01) |
| ***B65D 25/20*** | (2006.01) |
| ***B65D 85/671*** | (2006.01) |
| ***B65D 75/00*** | (2006.01) |
| ***B65B 63/04*** | (2006.01) |
| ***B65D 33/00*** | (2006.01) |

(52) U.S. Cl.

CPC ..... *B65D 83/0805* (2013.01); *B65B 53/00* (2013.01); *B65B 63/04* (2013.01); *B65D 25/205* (2013.01); *B65D 33/002* (2013.01); *B65D 71/08* (2013.01); *B65D 75/004* (2013.01); *B65D 85/671* (2013.01)

(58) Field of Classification Search

CPC ..... B65D 83/0805; B65D 25/205; B65D 33/002; B65D 71/08; B65D 75/004; B65D 85/671; B65B 53/00; B65B 63/04

USPC ..... 221/48

See application file for complete search history.

(56) References Cited

U.S. PATENT DOCUMENTS

| | | | | | |
|---|---|---|---|---|---|
| 2,878,628 | A * | 3/1959 | Curry | B65B 53/06 | 53/409 |
| 3,460,671 | A * | 8/1969 | Harm | B65D 71/08 | 206/391 |
| 3,664,498 | A * | 5/1972 | Dulmage | B65D 71/08 | 206/432 |
| 4,844,256 | A * | 7/1989 | Honegger | B65B 25/148 | 206/390 |
| 4,860,893 | A * | 8/1989 | Kaufman | B65D 33/24 | 206/390 |

(Continued)

FOREIGN PATENT DOCUMENTS

| | | | |
|---|---|---|---|
| JP | 07175413 | A * | 7/1995 |
| JP | 2002023315 | A * | 1/2002 |

(Continued)

*Primary Examiner* — Rakesh Kumar

(74) *Attorney, Agent, or Firm* — Boyle Fredrickson S.C.

(57) ABSTRACT

A dispensing package for plastic bags provides a core-less roll supporting on its outer surface a shrink-wrap sleeve providing the walls of the package. Upper and lower end forms being relatively more rigid than the shrink-wrap sleeve may be placed against the upper and lower edges of the core-less roll to provide improved robustness in shipping and package aesthetics.

13 Claims, 4 Drawing Sheets

(56) References Cited

U.S. PATENT DOCUMENTS 5,022,523 A * 6/1991 Honegger ..... B65B 25/148 206/390
5,192,133 A * 3/1993 Juel ..... B65D 88/1618 383/7
5,517,803 A * 5/1996 Stauber ..... B65B 63/04 206/390
5,927,294 A * 7/1999 Laurila ..... A45D 7/045 132/202
6,213,345 B1 * 4/2001 Plank ..... B65D 83/0805 206/494
6,305,572 B1 * 10/2001 Daniels ..... B65D 33/002 206/390
6,431,396 B1 * 8/2002 Daniels ..... B65H 35/10 206/554
6,488,222 B1 * 12/2002 West ..... B65D 33/002 242/160.4
7,066,422 B1 6/2006 Slocum
7,273,193 B2 9/2007 Slocum et al.
7,992,745 B2 * 8/2011 Sellars ..... A47K 10/3818 206/223
8,097,326 B2 * 1/2012 Wunderlich ..... B65H 45/22 428/126
8,834,335 B2 * 9/2014 Chen ..... B65D 33/002 493/199
9,517,605 B2 * 12/2016 Tan ..... B31B 50/00
2003/0062376 A1 * 4/2003 Sears ..... A47K 10/421 221/48
2013/0248646 A1 * 9/2013 Cobler ..... B65D 85/67 242/601
2015/0028148 A1 * 1/2015 Cobler ..... B65D 85/67 242/593
2015/0151881 A1 * 6/2015 Tan ..... B65D 33/001 383/33
2016/0001961 A1 * 1/2016 Trinko ..... B65D 83/0805 221/48

FOREIGN PATENT DOCUMENTS

JP 2002293370 A * 10/2002
JP 2005343497 A * 12/2005

* cited by examiner

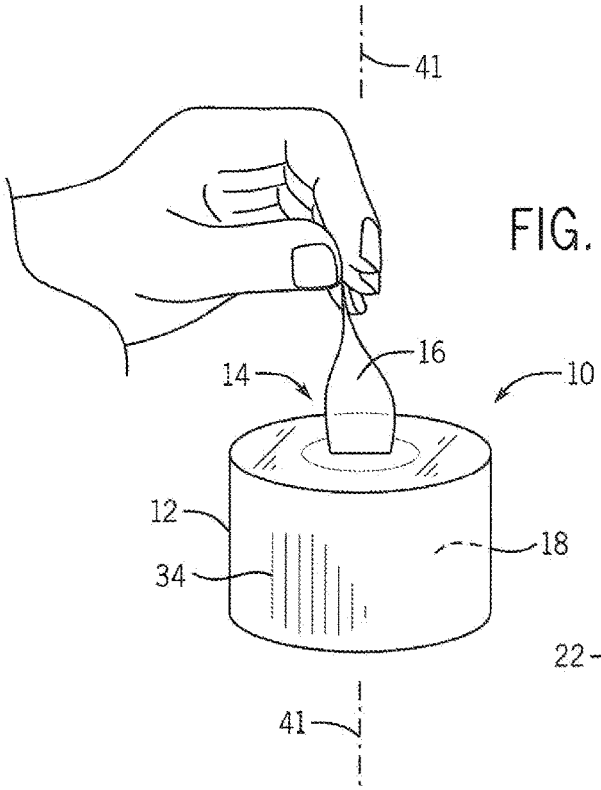
FIG. 1
FIG. 2a
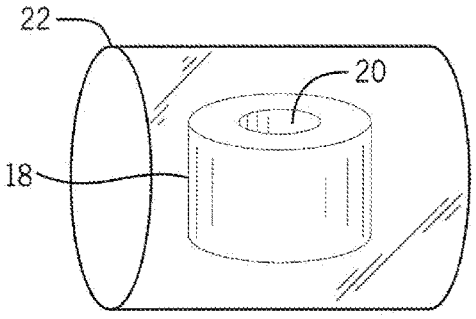
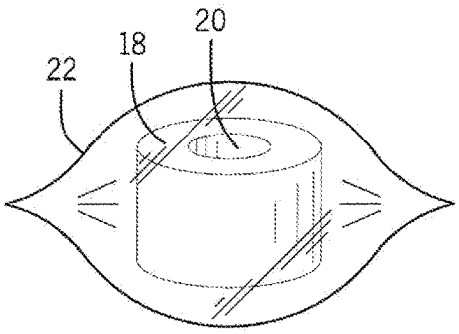
FIG. 2b
FIG. 2c
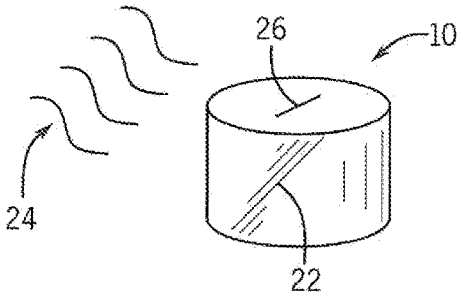

LOW BULK, CENTER-PULL BAG DISPENSER WITH END-FORMS

CROSS REFERENCE TO RELATED APPLICATION

This application claims the benefit of U.S. Provisional Application 62/021,401 filed Jul. 7, 2014 and hereby incorporated by reference.

BACKGROUND OF THE INVENTION

The present invention relates to a plastic bag dispensing system and in particular to a plastic bag dispenser that minimizes dispenser size and waste.

Plastic bags can be bulky and hence are normally rolled or folded into a compact form that may be held, for example, in a cardboard container for shipping and dispensing.

For certain applications, for example, disposal of dog waste or infant diapers, it would be useful to have multiple plastic bags in a compact package for dispensing. In these applications, the provision of an outer cardboard or similar container can substantially increase the size and weight of the package, rendering it too bulky or heavy for convenient carrying, for example, in a purse or the like.

SUMMARY OF THE INVENTION

The present invention provides a low-bulk, low weight container for dispensing compacted plastic bags. The dispenser forms the bags into a core-less roll and then uses the outer periphery of the core to support a heat-shrink film providing a protective outer package. The core-less roll may provide bags that are held to each other only by electrostatic or similar attraction and the package and the roll may cooperate to queue a later bag after a previous bag is removed.

As well as providing a package for the core-less rolls, the shrink-wrap is believed to help the core-less rolls resist separation between the bags in the rolls from shock during shipping. Accordingly, the invention may provide utility for core-less rolls of all sizes and even those that have secondary packaging around the shrink-wrap packaging.

More specifically then, the present invention provides, in one embodiment, a compact plastic bag-dispensing package constructed of a core-less roll providing a web of plastic bags each being a tubular sleeve of plastic extending along a hag axis and having a open end opposite a sealed end along the bag axis, the plastic bags arranged end-to-end in a web spiral-wrapped around a central roll axis. A plastic sleeve of heat-shrink material is heated to conform about an outer periphery of the core-less roll and provides a sleeve opening for removal of a bag from the core-less roll along the central roll axis.

It is thus a feature of at least one embodiment of the invention to provide a compact, lightweight dispensing system for plastic bags.

The outer surface of the sleeve supports ink printing directly on the sleeve or may support a flexible sheet label having descriptive printing attached to an outer cylindrical surface of the plastic sleeve.

It is thus a feature of at least one embodiment of the invention to eliminate the need for additional packaging containers that add bulk and weight to the package.

The package may include a first end-form having a central opening through which a bag may be removed, positioned between the plastic sleeve and a first face of the core-less roll formed of edges of the spiral-wrapped web, with the central opening aligned with the sleeve opening.

It is thus a feature of at least one embodiment of the invention to provide focused reinforcement of the shrink-wrap sleeve to improve the aesthetics of the package and/or its resilience during shipping.

The central opening may be recessed inwardly along the roll axis within a central opening of the core-less roll to provide a pocket at an outer surface of the first end-form.

It is thus a feature of at least one embodiment of the invention to provide a pocket to hold a next bag for dispensing.

A sticker may cover the pocket and the central opening.

It is thus a feature of at least one embodiment of the invention to protect the roll from contamination and/or release of bags during shipping.

One bag end within the pocket may be releasably attached to the sticker.

It is thus a feature of at least one embodiment of the invention to hold one bag end to be easily grasped by the consumer after the sticker is removed The package may further include a second end-form positioned between the plastic sleeve and a second face of the core-less roll formed of edges of the spiral-wrapped web opposite the first face.

It is thus a feature of at least one embodiment of the invention to improve the symmetry of the package and better protect it during shipping and handling.

The first and second end-forms may provide substantially circular disks having an outer circumference extending proximate to a cylindrical outer wall of the core-less roll.

It is thus a feature of at least one embodiment of the invention to protect the package against excessive deformation.

The first and second end-forms may each have a radius less than a radius of the cure-less roll about the roll axis.

It is thus a feature of at least one embodiment of the invention to provide a visual "plumpness" to the package caused by a pillowing outward of the package from the end-forms.

The bags of the web may be overlapped at their ends to be separated without a tearing of bag material.

It is thus a feature of at least one embodiment of the invention to provide a dispensing action that does not remove more than one bag at a time. By eliminating perforated attachments, the resistance of the bags to being pulled through the package opening can fully separate adjacent bags while still ensuring a second bag is properly queued for removal.

The outer bags of the roll with respect to the roll axis may overlap adjacent inner bags of the roll on an inner surface of the inner bags.

It is thus a feature of at least one embodiment of the invention to preserve sufficient adhesion between the bags to ensure proper sequential dispensing.

Each bag may be folded into pleats extending along the bag axis to reduce a height of the core-less roll.

It is thus a feature of at least one embodiment of the invention to provide a stable aspect ratio to the package suitable for relying on the shrink-wrap film.

The sealed ends of the bags may seal the pleats together.

It is thus a feature of at least one embodiment of the invention to prevent in resilience in the sealed pleadings from separating the bags prematurely.

These particular objects and advantages may apply to only some embodiments falling within the claims and thus do not define the scope of the invention.

BRIEF DESCRIPTION OF THE DRAWINGS

FIG. 1 is a perspective view of the package of the present invention showing dispensing of a bag from a dispenser package of the present invention having a core-less roll surrounded by a shrink-wrap film;

FIGS. 2*a*-2*c* are simplified perspective views of the steps of producing the package of the present invention showing the formation of a sealed shrink-wrapped bag around a core-less roll, shrinking the bag to conformity with the core-less roll, and adding a slot-dispensing feature;

DETAILED DESCRIPTION OF THE PREFERRED EMBODIMENT

Figure 3:
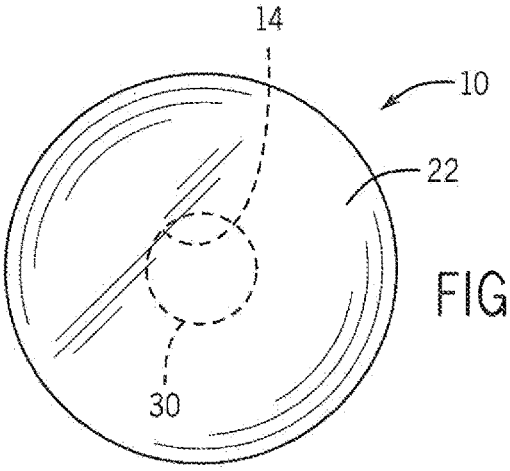
FIG. 3 is a top plan view of the core-less roll of FIG. 1 showing a first dispensing option having a perforated opening.

Referring now to FIGS. 1 and 2*a*, a bag-dispensing package 10 of the present invention may provide a generally cylindrical package form 12 having a dispensing opening 14 in the center of one base of the cylinder. Plastic bags 16 may be dispensed through the opening 14 from a core-less roll 18 generally along a central axis 41.

The core-less roll 18 formed of plastic bags 16 spiral-wound about the central axis 41 and a center, open cylindrical volume 20 without the imposition of a center cardboard tube or the like. In the core-less roll 18, the bags 16 may be attached only by electrostatic force to be readily separated when drawn through the opening 14 from out of the center of the core-less roll 18.

A method of fabricating core-less rolls 18 of plastic bags 16 suitable for use with the present invention may be found in U.S. Pat. Nos. 7,066,422 and 7,273,193 both hereby incorporated by reference in their entirety.

Referring now to FIGS. 2*a*-2*c*, after fabrication of the core-less roll 18, it may be placed within a tube of shrink-wrap (heat-shrink) film 22 of the type known in the art sized to closely conform to the size of the core-less roll 18. When the core-less roll 18 is cylindrical, the shrink-wrap film 22 will conform to its outer periphery being the sidewalls of the cylinder and two opposite cylindrical bases.

As is generally understood in the art, shrink-wrap film 22 will be a polymer film such as a polyethylene or polypropylene stretched when it was warm, for example, on a tenter-frame to reorient the molecules from their initial patterns in an expanded form so that when heated the shrink-wrap film 22 contracts, typically by an amount greater than 10 percent and often greater than 30 percent In one embodiment, the axis of the tube of shrink-wrap film 22 may be generally perpendicular to the axis of the open cylindrical volume at the center of the core-less roll 18.

As shown in FIG. 2*b*, open ends of the tube of shrink-wrap film 22 may be heat sealed, for example, using an L-bar sealer to provide a closed volume within the shrink-wrap film 22 holding the core-less roll 18.

Referring now to FIG. 2*c*, the application of heat 24 to the shrink-wrap film 22, for example, using a shrink tunnel or hot-air blowers, may then cause the shrinking of the shrink-wrap film 22 to closely conform to the outlines of the core-less roll 18 and in particular to provide a substantially continuous unbroken surface of shrink-wrap film 22 at upper and lower bases of the bag-dispensing package 10.

It will also be appreciated that the shrink-wrap film 22 shown in FIG. 2*a* may be oriented so that the open ends of the tube of the shrink-wrap film 22 are vertically aligned with respect to the core-less roll 18 as depicted. The size of the tube of shrink-wrap film 22 may be adjusted so that in shrinking it pros ides a natural orifice aligned with the open cylindrical volume 20.

Figure 4:
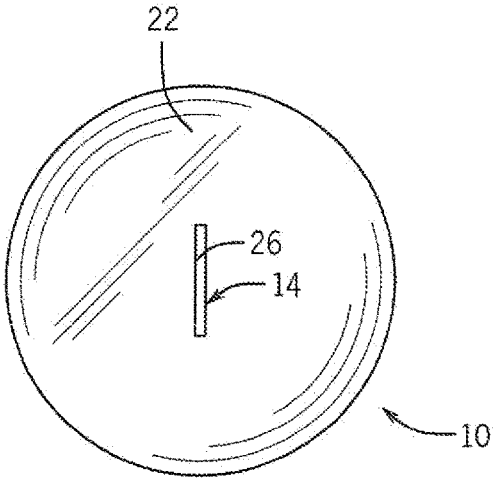
FIG. 4 is a figure similar to that FIG. 3 showing a second dispensing option providing a slit.

Referring now also to FIG. 4, a knife or die may be used to make a slit cut 26 in one base through the heat shrink-wrap film 22 positioned above the center of the open cylindrical volume 20 of the core-less roll 18. The slit cut 26 provides access to bags from the center of the core-less roll 18 through the cut 26 and also serves to retain a next overlapping bag partially through the cut 26, when the preceding bag is removed, for easy access of the succeeding bag. The slit cut 26 provides the opening 14.

Referring now to FIG. 3, alternatively the shrink wrap film 22 around the opening 14 may be perforated with perforations 30 after the shrinking operation that allow removal of a circular portion of the shrink-wrap film 22 for access to the bags 16 of the core-less roll 18 from the center of the core-less roll 18 through the open volume 20. Because the bags 16 are removed from a center of the core-less roll 18, the outer portions of the core-less roll 18 continue to support the shrink-wrap film 22.

Figure 5:
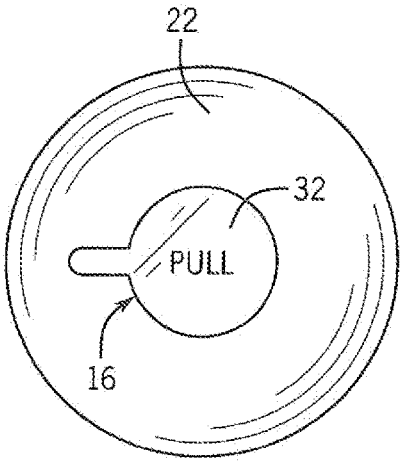
FIG. 5 is a figure similar to that of FIG. 4 showing a third dispensing option providing an adhesive label cover.

Referring to FIG. 5, an adhesive sticker 32 may be placed over the opening 14 provided in the embodiment of FIG. 3 or FIG. 4 during shipping and then removed for use of the bag-dispensing package 10 by a consumer. A portion of one bag 16 may be partially captured by the sticker 32 during manufacturing so that it is readily accessible upon removal of the sticker 32. Each bag 16 when fully withdrawn from the core-less roll 18 may draw the next bag upward through the opening until the bags 16 are fully consumed.

Referring again to FIG. 1, the outer surface of the bag-dispensing package 10 may be printed with images or text 34 with ink applied directly to the polymer of the shrink-wrap film 22 providing consumer information, product labeling, and the like. The shrink-wrap film 22 may be transparent or opaque as desired.

Figure 6:
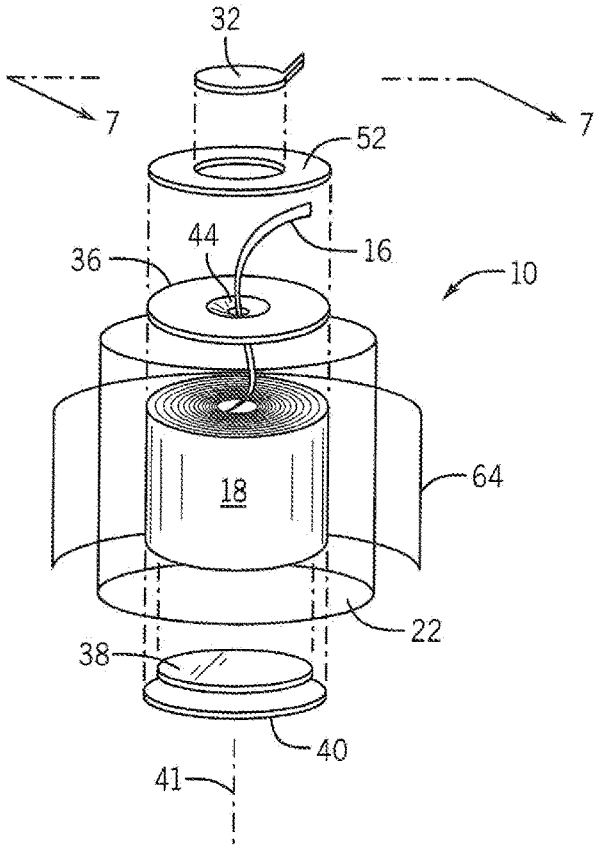
FIG. 6 is an exploded diagram of a second packaging embodiment using rigid end forms within the shrink-wrap bag.
Figure 7:
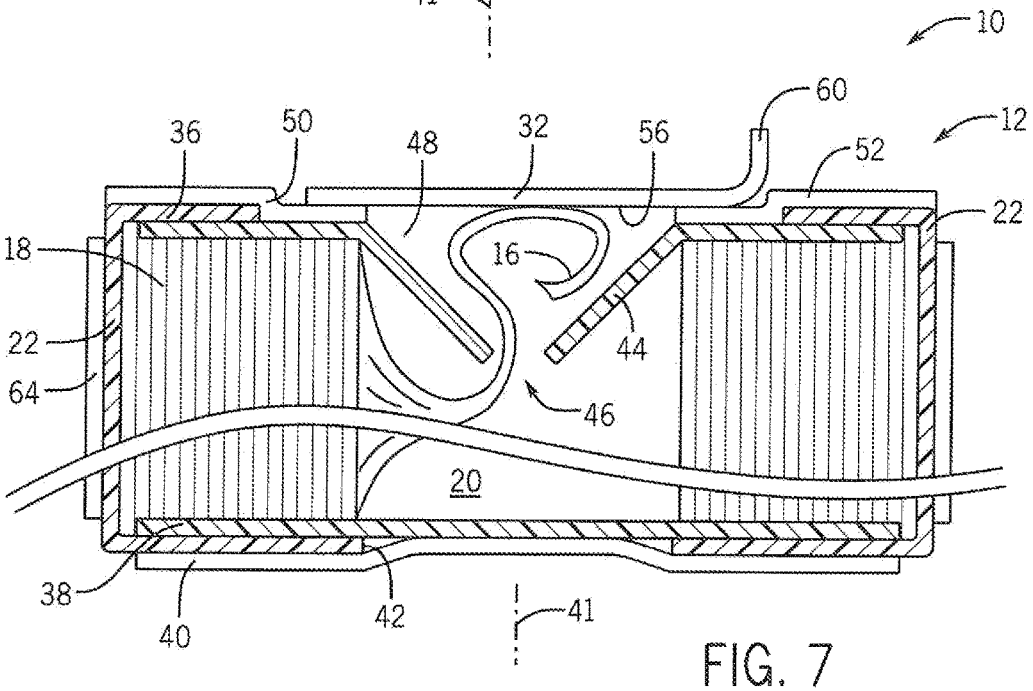
FIG. 7 is a cross-section along line 7-7 of FIG. 6.

Referring now to FIGS. 6 and 7, in an alternative embodiment, end-forms 36 and 38, in the form of circular disks constructed of a relatively stiff material such as cardboard or thermoplastic, may be placed against the upper and lower bases of the core-less roll 18, the latter which approximates a circular cylinder. These end-forms 36 and 38 are then captured against the upper and lower bases of the core-less roll 18 by shrinkage of the shrink-wrap film 22 and, as so held, prevent undue compression of the upper and lower edges of the core-less roll 18 by the shrink-wrap film 22 and protect the core-less roll 18 from deformation during shipping.

A printed circular label 40 of paper or other similar material may optionally cover the lower end-form 38 as adhered thereto, for example, by a pressure sensitive adhesive attached to the printed circular label 40. As so positioned, the printed circular label 40 covers the seam between the inner edge 42 of the shrunken shrink-wrap film to provide a more finished appearance and to seal the package against infiltration of contaminants. The printed circular label 40 also provides a surface on which to print additional information to be displayed on the bottom of the generally cylindrical package form 12, for example, a UPC code and other labeling information.

The upper end-form 36 may provide for an inwardly extending funnel-portion 44 that may serve to capture the end of one bag 16 threaded through an orifice 46 of the funnel-portion 44. As so captured, the end of the bags 16 is held, within the funnel-portion 44 extending into the volume 20 and thus recessed within the cylindrical package form 12. The upper end-form 36 may be advantageously injection molded or thermoformed thermoplastic as is understood in the art.

The diameter of the upper end-form 36 and lower end form 38 may be substantially equal to the diameter of the core-less roll 18 to protect the core-less roll 18 from deformation and possible separation of the bags 16. Desirably, the diameter of the upper end-form 36 and lower end-form 38 may be slightly less than the core-less roll 18 so that the sidewalls of the package 10 pillow outward by ⅛ to ¼ inch for pleasing aesthetic effect and to prevent a hard edge of the end forms 36 and 38 from causing abrasion of the shrink-wrap film 22 or unpleasant contact with the consumer. The end forms 36 and 38 are relatively stiff compared to the shrink-wrap film 22 and the bags 16 to retain their shape after minor deformation.

Again the inner seam edge 50 of the upper end of the shrink-wrap film 22 may be covered with a circular paper label 52 having a center opening 54 exposing the funnel-portion 44 and a pressure sensitive adhesive to attach it over the upper end of the cylindrical package form 12. As described above, a sticker 32 may have a pressure sensitive adhesive 56 on its lower surface to cover the opening 54 and the funnel-portion 44 during shipping. The funnel-portion 44 and sticker 32 thus provide an enclosed space 48 beneath the upper end of the cylindrical package form 12 in which the end of the bags 16 may be retained protected yet available for easy access by the consumer. The adhesive on the sticker 32 may retain and hold the end of the bag 16 adhered against the inner surface of the sticker 32 to prevent it from slipping out of the orifice 46. An unadhered tab 60 on sticker 32 may be provided to allow the sticker 32 to be easily removed by pulling the tab 60 upward to remove the sticker 32 and pull with it the end of bag 16.

A thin and flexible paper label 64 may be wrapped around the outer circumference of the shrink-wrap film 22 when it is shrunken to provide a surface supporting additional printed material for the consumer. The label 64 thus eliminates the need for complex printing of the shrink-wrap film 22 if desired. Alternatively a printed shrink-wrap film may be used eliminating the need for the paper label 64 or printing may be applied directly to the shrink-wrap film 22 with appropriate pre-distortion.

Figure 8:
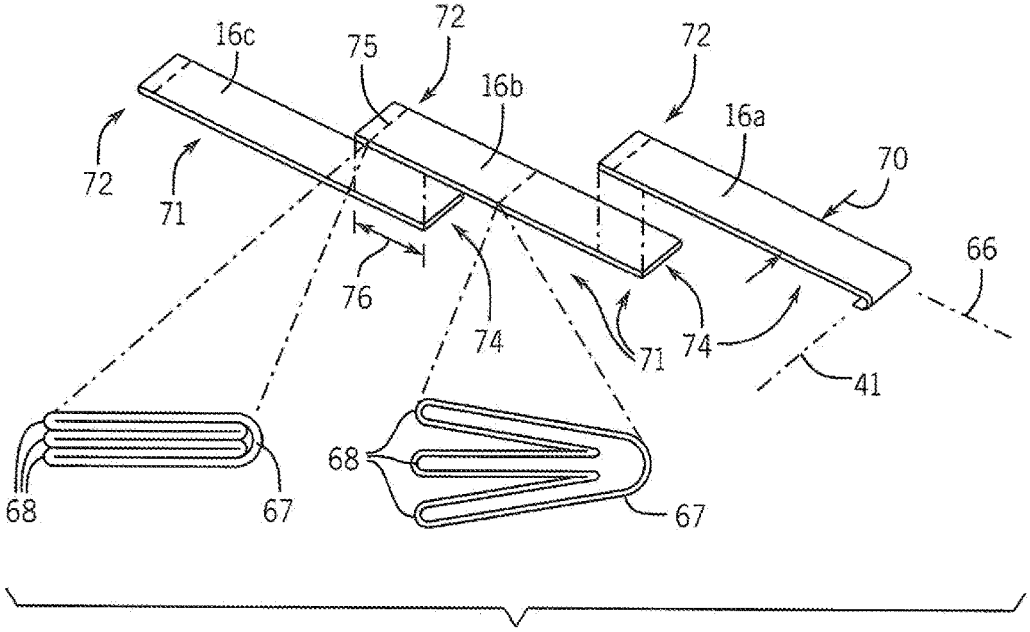
FIG. 8 is an exploded diagram of a web formed of multiple overlapping bags showing pleating in cross-section at various locations on one bag.
Figure 9:
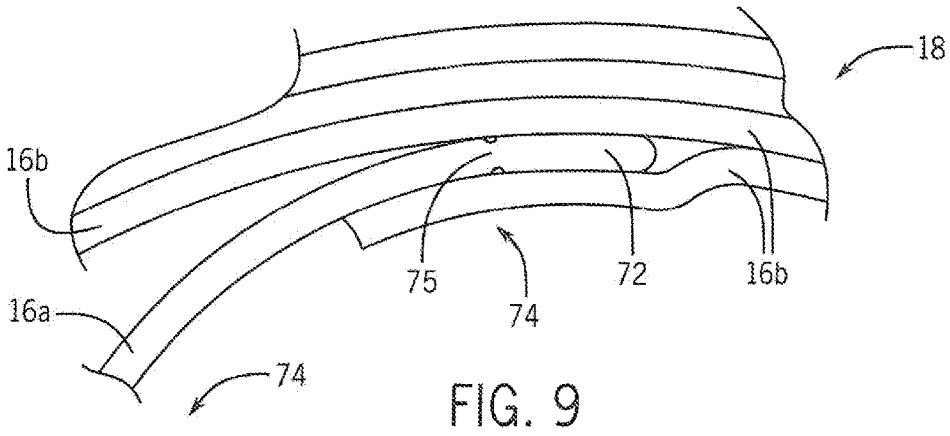
FIG. 9 is a fragmentary top plan view of the core-less roll of FIG. 6 showing the relative overlap of adjacent bags.

Referring now to FIG. 8, each bag 16 may comprise a tubular sleeve 67 of flexible plastic film extending generally along a tube axis 66 and may have multiple pleats 68 extending along the axis to convert the tube into a flattened band 71 having a width 70 (being generally the height of the package 10) much less than the flattened diameter of the tube and for example approximately ⅓ of that flattened diameter provided by three pleats extending approximately the full width 70. A closed end 72 of each bag 16 opposite an open end 74 may be heat sealed at a seam line 75 fusing each of the pleats 68 together in overlapping configuration. Each of the bands 71 of different bags 16*a*-16*e* (only three shown for clarity) may be overlapped by an overlap distance 76, for example, being a few inches and much less than one fourth the length of the bag along axis 66. As shown in FIG. 9, each inner bag (e.g. 16*a*) will be withdrawn from the package 10 before an adjacent outer bag (e.g. 16*b*) however the outer bag 16*b* will overlap (underlap) with the inner bag 16*a* on an inner surface of the inner bag 16*a* to help preserve adhesion between the two.

The outside diameter of the cylindrical package form 12 may be sized to fit in a standard automotive cupholder and, for example, may be limited to no more than three inches in diameter and less than four inches in height. The final bags in the core-less roll 18 may be marked with a distinguishing color or the like to signal a need to obtain replacement stock.

It will be appreciated that the present cylindrical package form 12 may be used with existing dispenser racks intended for holding rectangular cardboard boxes through the use of an adapter providing an outer rectangular surface for being held firmly within the dispenser rack and an inner cylindrical bore for holding the present cylindrical package form 12.

It will be appreciated that the design of the package of the present invention not only reduces packaging material but provide substantial flexibility in changing the size of the package simply by changing the number of bags 16 in a core-less roll 18. It will be appreciated that the number of bags may be varied within a given range without necessarily changing any of the other packaging components to the extent that the diameter of the cylindrical package form 12 may change only slightly. It will be appreciated that the bags may be attached by perforations in some embodiments.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A compact plastic bag-dispensing package comprising a core-less roll providing a web of plastic bags, each plastic bag being a tubular sleeve of plastic extending along a bag axis and having an open end opposite a sealed end along the bag axis, the plastic bags being unattached by perforations and arranged end-to-end in a web spiral-wrapped around a central roll axis;

a plastic sleeve of heat-shrink material conforming about an outer periphery of the core-less roll compressing the core-less roll and providing a sleeve opening for removal of a bag from a center of the core of the core-less roll along the central roll axis;

wherein the bags of the web are overlapped at their ends to be separated without a tearing of bag material or perforation between bags; and wherein each bag is folded to provide multiple pleats extending outward from one edge of the bag along the bag axis each pleat extending a height of the folded bag perpendicular to the bag axis to reduce the height of the core-less roll with a first pleated end sealed along the entire height of the folded bag and an opposite second pleated end unsealed along entire height of the folded bag;

wherein each given outer bag is wound around an inner given bag with respect to the center of the roll, except an end of the given outer bag in overlapping contact with an end of the inner bag is inside the end of the inner bag with respect to the core with an unsealed end of one bag in direct contact with an entire length of the full height seam of an adjacent bag.

2. The compact plastic bag dispensing package of claim 1 further wherein the surface of the sleeve supports ink printing on the sleeve.

3. The compact plastic bag dispensing package of claim 1 further including a flexible sheet label having descriptive printing attached to an outer cylindrical surface of the plastic sleeve.

4. The compact plastic bag dispensing package of claim 1 further including a first end-form having a central opening through which a bag may be removed, positioned between the plastic sleeve and a first face of the core-less roll formed of edges of the spiral-wrapped web, with the central opening aligned with the sleeve opening.

5. The compact plastic bag dispensing package of claim 4 wherein the central opening is recessed inwardly along the roll axis within a central opening of the core-less roll to provide a pocket at an outer surface of the first end-form.

6. The compact plastic bag dispensing package of claim 5 further including a sticker removably covering the pocket and the central opening.

7. The compact plastic bag dispensing package of claim 6 wherein one bag end within the pocket is releasably attached to the sticker.

8. The compact plastic bag dispensing package of claim 4 further including a second end-form positioned between the plastic sleeve and a second face of the core-less roll formed of edges of the spiral-wrapped web opposite the first face.

9. The compact plastic bag dispensing package of claim 8 wherein the first and second end-forms provide substantially circular discs having an outer circumference extending proximate to a cylindrical outer wall of the core-less roll.

10. The compact plastic bag dispensing package of claim 9 wherein the outer circumference of the first and second end-forms each have a radius less than a radius of the core-less roll about the roll axis.

11. The compact plastic bag dispensing package of claim 4 wherein the first and second end-forms are relatively stiffer than the overlying plastic sleeve.

12. The compact plastic bag dispensing package of claim 1 wherein outer bags of the roll with respect to the roll axis overlap adjacent inner bags of the roll on an inner surface of the inner bags.

13. The compact plastic hut dispensing package of claim 1 wherein the sealed ends seal the pleats together.

* * * * *